United States Patent [19]

Conley

[11] Patent Number: 4,922,850

[45] Date of Patent: May 8, 1990

[54] GOLF GLOVE WITH STROKE COUNTER

[76] Inventor: Michael J. Conley, 50 Birdsong Cir., East Amherst, N.Y. 14051

[21] Appl. No.: 268,758

[22] Filed: Nov. 9, 1988

[51] Int. Cl.[5] ..... A63B 57/00

[52] U.S. Cl. ..... 116/222; 116/223; 116/309; 116/321; 116/334; 273/32 R; 273/DIG. 26; 273/DIG. 30

[58] Field of Search ..... 116/223, 306, 309, 311, 116/313, 315, 318, 319, 320, 321, 323, 324, 328, 330, 332, 334, 308; 2/161 R, 161 A, 160; 273/DIG. 26, 32 R, 183 R, DIG. 30; 446/901

[56] References Cited

U.S. PATENT DOCUMENTS

| | | | |
|---|---|---|---|
| 936,437 | 10/1909 | Fields et al. | 2/160 |
| 1,309,150 | 7/1919 | Monfort | 24/3 R |
| 1,416,653 | 5/1922 | Lenneberg | 2/160 |
| 1,731,749 | 10/1929 | Miller et al. | 116/309 |
| 2,658,468 | 11/1953 | Enfield | 116/308 |
| 3,635,190 | 1/1972 | Araki | 116/120 |
| 3,670,574 | 6/1972 | Edwards | 73/379 R |
| 3,716,016 | 2/1973 | Aylesworth et al. | 116/120 |
| 3,847,110 | 11/1974 | Inoue | 116/223 |
| 3,965,488 | 6/1976 | Paulucci | 2/161 |
| 4,040,126 | 8/1977 | Cecil | 2/161 |
| 4,042,977 | 8/1977 | Antonious | 2/161 |
| 4,489,444 | 12/1984 | Graham | 2/160 |
| 4,519,781 | 5/1985 | Boyd | 2/160 |
| 4,729,472 | 3/1988 | Lubin et al. | 116/308 |
| 4,738,449 | 4/1988 | Droz | 273/29 R |
| 4,761,835 | 8/1988 | Chen | 2/160 |
| 4,766,611 | 8/1988 | Kim | 2/161 A |

*Primary Examiner*—Allan N. Shoap
*Assistant Examiner*—Jeffrey J. Hohenshell
*Attorney, Agent, or Firm*—Joseph P. Gastel

[57] ABSTRACT

A golf glove having a golf stroke counter mounted on the back thereof which includes a cursor, which is either a straight member or a dial which is retained within layers of material on the back of a golf glove and which can be moved to positions designating the specific number of strokes taken and which is frictionally engaged in such positions.

15 Claims, 2 Drawing Sheets

Fig. 1.
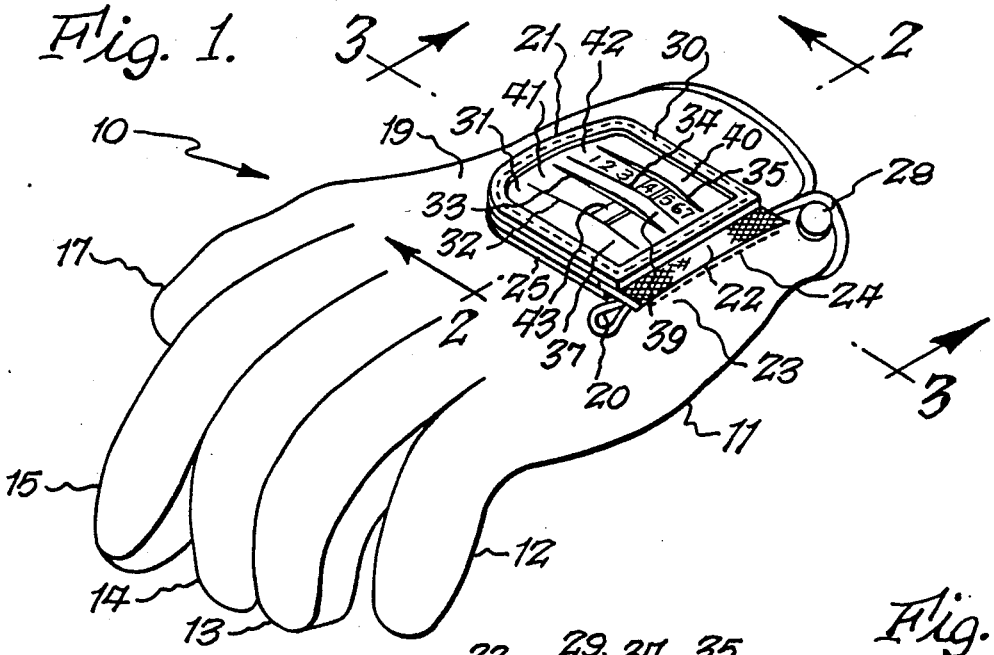
Fig. 2.
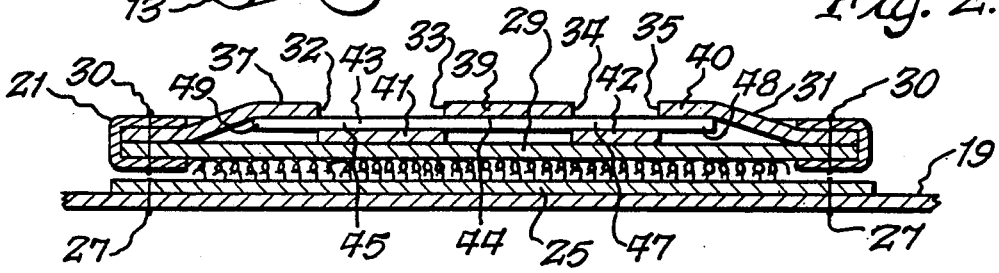
Fig. 3.
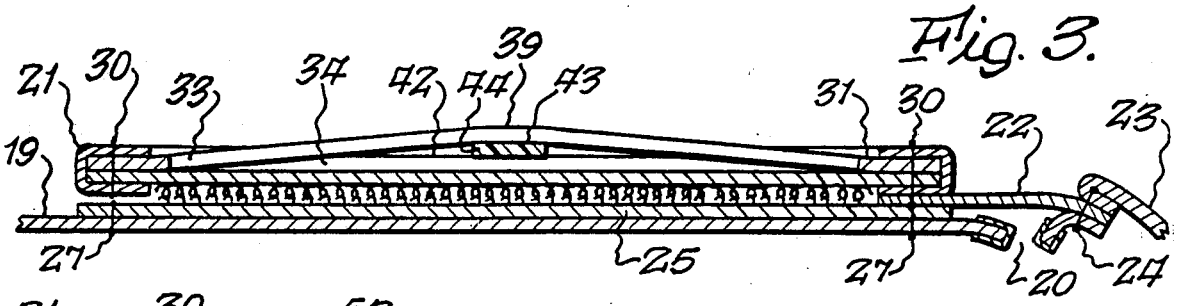
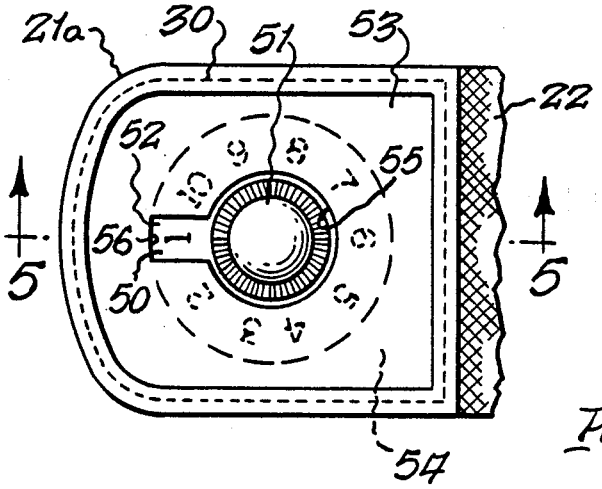
Fig. 4.
Fig. 5.
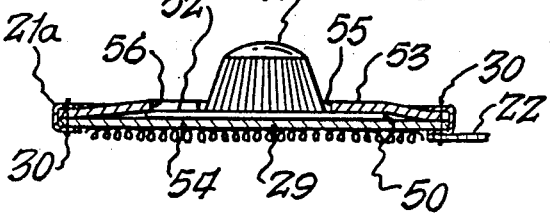

GOLF GLOVE WITH STROKE COUNTER

BACKGROUND OF THE INVENTION

The present invention relates to a golf glove with a stroke counter for indicating the number of strokes taken by a golfer.

Certain golfers, especially those first starting the game, desire some sort of device for counting strokes so that they do not lose track of their score for each hole. Devices of this type are shown in U.S. Pat. Nos. 3,635,190 and 3,716,016.

SUMMARY OF THE INVENTION

It is the object of the present invention to provide an improved golf stroke counter which can readily be incorporated into an existing golf glove by making a minor modification thereof.

Another object of the present invention is to provide an improved golf stroke counter which is relatively unobtrusive and does not protrude excessively from the golf glove.

A further object of the present invention is to provide an improved golf stroke counter which can be applied to the back of an existing golf glove by merely adding it thereto. Other objects and attendant advantages of the present invention will readily be perceived hereafter.

The present invention relates to a golf glove and golf stroke counter combination comprising a golf glove having a back thereon, a plurality of indicia on said back, a cursor, and means for manually moving said cursor relative to said indicia to thereby indicate the number of golf strokes taken by a golfer. In its more specific form, the cursor is retained on the back of the golf glove between layers of material thereon.

The various aspects of the present invention will be more fully understood when the following portions of the specification are read in conjunction with the accompanying drawings wherein:

BRIEF DESCRIPTION OF THE DRAWINGS

FIG. 1 is a perspective view of a golf glove having the improved golf stroke counter of the present invention mounted on the back thereof;

FIG. 2 is a fragmentary enlarged cross sectional view taken substantially along line 2—2 of FIG. 1;

FIG. 3 is an enlarged fragmentary cross sectional view taken substantially along line 3—3 of FIG. 1;

FIG. 4 is a fragmentary plan view of a modified embodiment of the present invention;

FIG. 5 is a fragmentary cross sectional view taken substantially along line 5—5 of FIG. 4;

DESCRIPTION OF THE PREFERRED EMBODIMENTS

Figure 6:
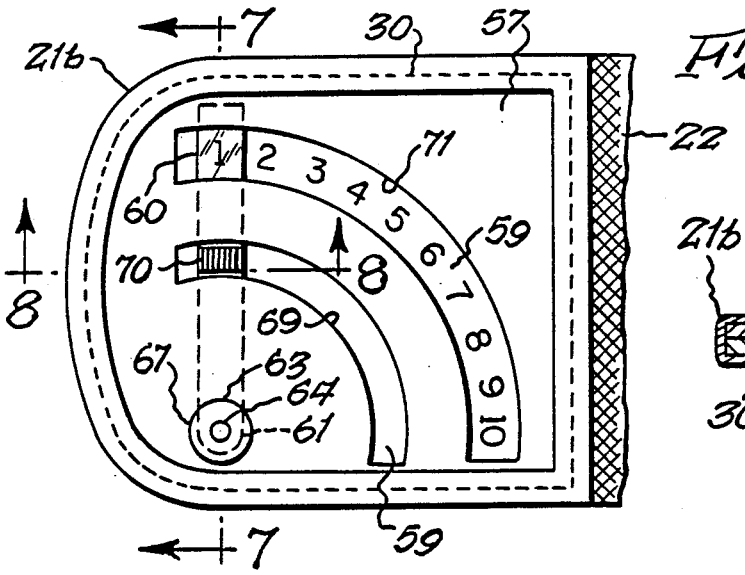
FIG. 6 is a fragmentary plan view of still another modified embodiment of the present invention.

The golf glove 10 of the present invention includes a main portion 11 which encircles the palm and back of the hand and a plurality of fingers 12, 13, 14, 15 and 17 extending therefrom. The glove also includes a back portion 19 which has an opening 20 therein. A fastening tab 21 has its portion 22 secured to the back portion 23 of the glove by a row of stitching 24. A layer of hook fabric 25 is stitched to back 19 by stitching 27 which extends around the perimeter of fabric 25. A cooperating piece of pile fabric 29 is secured to the underside of tab 21 by stitching 30. The layers 25 and 29 of cooperating hook and pile fabric are commonly known under the trademark VELCRO. In normal use the portion 19 of the golf glove which surrounds the back and the palm is tightened in the well known manner by pulling the tab 21 to close opening 20 and thereafter causing the hook and pile fabric to be engaged. A ball marker button 28, which is used during putting, is removably attached to the golf glove by a snap fastener.

In accordance with the present invention, a golf stroke counter is mounted on the back 19 of the glove. In the embodiment of FIGS. 1–3 the counter is mounted on tab 21. In this respect, it is incorporated into the tab by slitting the layer 31 of material, which is a normal portion of the tab, along four slit lines 32, 33, 34 and 35 to thereby essentially form two layers of material. The outer layer consists of strips 37, 39 and 40, and the inner layer consists of strips 41 and 42. A cursor 43 in the form of a relatively stiff member, which may be transparent plastic, is essentially woven into the layers of the material so that its central portion 44 lies under the central upper layer 39 and its adjacent portions 45 and 47 overlie the lower layer portions 41 and 42. The extreme end portions 49 and 48 of the cursor 43 lie under the outer layer portions 37 and 40. Numerals (not numbered) are marked onto lower layer 42, as shown in FIG. 1. As each golf stroke is made, the cursor is manually moved in a direction substantially perpendicularly to the slits 32, 33, 34 and 35 so as to overlie the numeral designating the last stroke, which can be viewed because the cursor is transparent.

It is especially to be noted that the foregoing golf stroke counting structure has been incorporated into an existing glove by merely slitting existing layer 31 of material which is already a part of the glove and applying the numerals to a portion thereof and thereafter inserting the cursor 43. Furthermore, while the numerals have been shown on lower layer portion 42, it will be appreciated that they can be applied to any other portion of member 31, either the portions of the upper layer or the lower layer.

In FIGS. 4 and 5 another embodiment of the present invention is disclosed. Tab **21*a* is a modification of tab 21 of FIGS. 1–3. Tabs 21 and 21*a* were originally identical before they were modified. In this embodiment the cursor is a circular dial 50 which has a knob 51 secured thereto and has a plurality of numerals (not numbered) on its outer periphery as shown. Insofar as the counter is concerned, its outer annular peripheral portion 52 is retained between upper layer 53 and lower layer 54, which in this instance is the rear surface of the hook and pile fabric 29. Upper layer 53 is essentially a form of existing layer 31 of FIGS. 1–3, which has been modified in a different manner. Knob 51 extends through the circular opening 55 in upper layer 53, and the outer peripheral portion 52 of the dial is retained between the adjacent portions of the upper layer 53 and lower layer 54. A second opening 56 is provided in the upper layer so that the numeral which underlies this opening can be viewed. In use, as each stroke is made, the knob 51 is turned to bring the corresponding stroke number into opening 56**.

Figure 8:
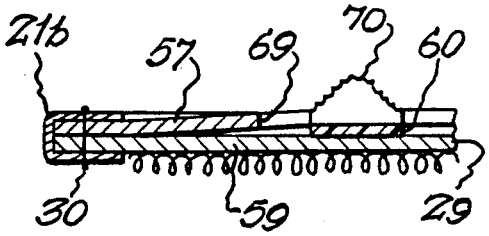
FIG. 8 is an enlarged fragmentary cross sectional view taken substantially along line 8—8 of FIG. 6.
Figure 7:
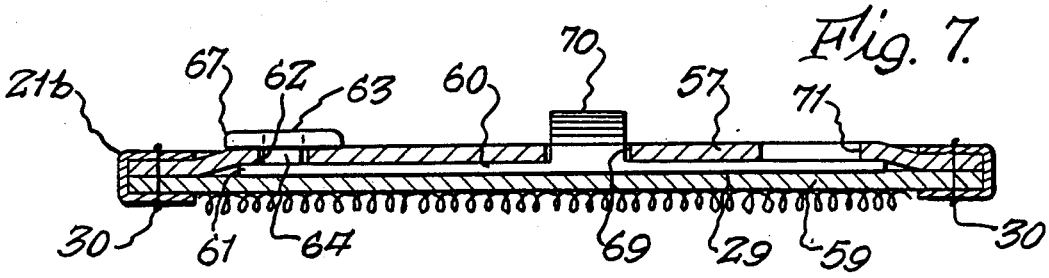
FIG. 7 is an enlarged fragmentary cross sectional view taken substantially along line 7—7 of FIG. 6.

Another embodiment of the present invention is shown in FIGS. 6–8. In this embodiment the tab **21*b* was identical to tab 21 disclosed in FIGS. 1–3 before either was modified. Tab 21*b* includes an upper layer 57 and a lower layer 59, which is the hook and pile fabric 29. The cursor 60 includes an end portion 61 which is pivotally mounted in aperture 62 by retaining pin 63 which is attached to end portion 61 and which has a stem 64 extending through aperture 62. An enlarged portion 67 of the retaining member bears on the upper surface of outer layer 57. An arcuate opening 69, which is concentric with the axis of stem 64, is located in upper layer 57, and a knob 70, which is affixed to cursor 60, extends therethrough. A second arcuate opening 71, which is concentric with opening 69, is also located in upper layer 57, and a plurality of numerals (not numbered) are located thereon. As each golf stroke is made, the knob 70 is grasped and moved to overlie the corresponding numeral, which can be viewed because the cursor 60 is transparent. As in the embodiment of FIGS. 1–3**, the cursor is a relatively rigid member. Furthermore, while the numerals have been shown on the lower layer, it will be appreciated that they can be placed at suitable locations on the upper layer as long as the cursor can cooperate therewith.

Figure 9:
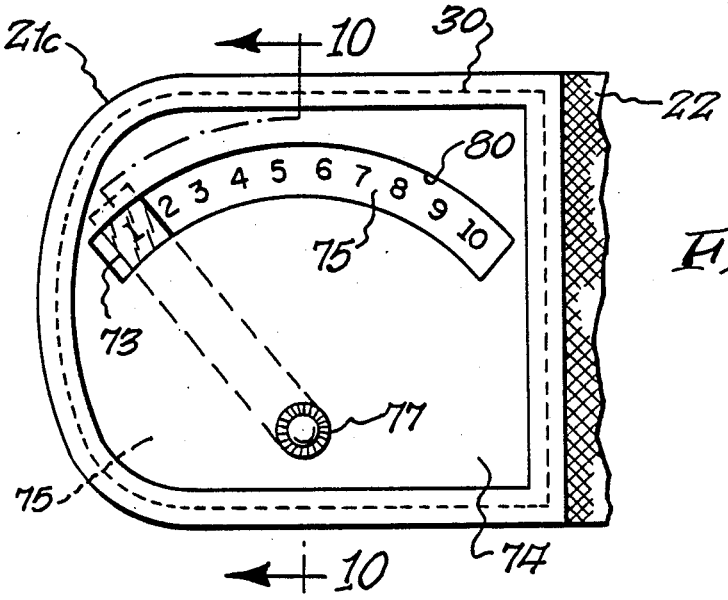
FIG. 9 is a fragmentary plan view of still another embodiment of the present invention.
Figure 10:
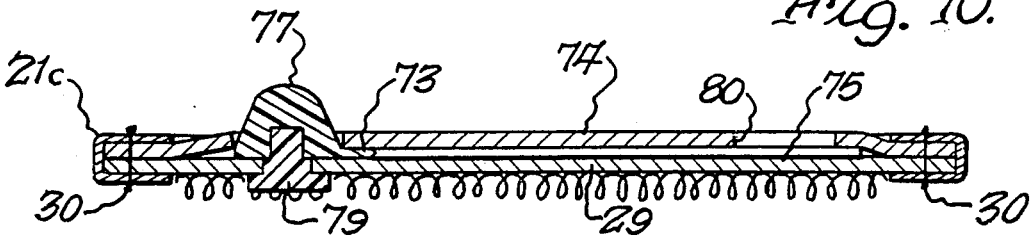
FIG. 10 is an enlarged fragmentary cross sectional view taken substantially along line 10—10 of FIG. 9.

In FIGS. 9 and 10 a still further embodiment of the present invention is disclosed which is located on the tab **21*c* of the golf glove, which was originally identical to tab 21 before either were modified. In this embodiment the cursor 73 is also an elongated relatively rigid member which is located between upper layer 74 and lower layer 75, which is a portion of the hook and pile fabric. The cursor 73 includes a knob 77 which is secured to lower layer 75 by means of a rivet 79 which extends through lower layer 75. An arcuate opening 80 is formed in upper layer 74, and it is concentric with the axis of rivet 79 and knob 77. As each stroke is taken, the knob 77 is manually grasped and moved to cause the transparent cursor 73 to overlie the corresponding numeral. As with the other embodiments, it will be appreciated that the numerals could also be located on the upper layer 74**.

In all of the embodiments of the present invention, the placement of the cursor or dial, as the case may be, between two layers of closely spaced material retains the cursor in the position in which it was last moved, because of the frictional engagement therebetween.

While the present invention has been described with respect to the closing tab of an existing golf glove, which can thus be modified to include the stroke counter, it will be appreciated that the stroke counter need not necessarily be located on the tab but can be incorporated into the back of any other type of golf glove which either has two layers of material or which has a single layer and can be modified by adding a layer of material thereto.

While the strokes taken by a golfer have been designated by numerals on the foregoing embodiments, it will be appreciated that other types of indicia may be used, such as dots, letters, stars, or foreign equivalents of numerals, and such indicia are within the scope of the following claims.

While preferred embodiments of the present invention have been disclosed, it will be appreciated that the present invention is not limited thereto but may be otherwise embodied within the scope of the following claims.

I claim:

1. A golf glove and golf stroke counter combination comprising a golf glove having a back thereon with a longitudinal opening which separates portions of said back, a tab on said back for closing said opening, said tab having a plurality of layers of sheet material which formed a preexisting original portion of said tab, a plurality of indicia associated with one of said layers, and a cursor effectively retained between said layers for selective manual movement relative to said indicia to thereby indicate the number of golf strokes taken by a golfer.

2. A golf glove and golf stroke counter combination as set forth in claim 1 wherein said plurality of layers of sheet material comprise a plurality of adjacent strips of material, and wherein said cursor comprises an elongated relatively rigid member retained by said strips of material overlying and underlying portions of said elongated relatively rigid member.

3. A golf glove and golf stroke counter combination comprising a golf glove having a back thereon, a plurality of layers of sheet material associated with said back, a plurality of indicia associated with one of said layers, and a cursor effectively retained between said layers for selective manual movement relative to said indicia to thereby indicate the number of golf strokes taken by a golfer, said plurality of layers of sheet material comprising an upper layer and a lower layer, a plurality of substantially parallel slits in said upper layer forming adjacent strips of material thereon, and said cursor comprising an elongated relatively rigid member retained on said upper layer by said strips of material overlying and underlying spaced portions of said elongated relatively rigid member.

4. A golf glove and golf stroke counter combination comprising a golf glove having a back thereon, a plurality of layers of sheet material associated with said back, a plurality of indicia associated with one of said layers, a cursor effectively retained between said layers for selective manual movement relative to said indicia to thereby indicate the number of golf strokes taken by a golfer, said plurality of layers of sheet material comprising a plurality of adjacent strips of material, said cursor comprising an elongated relatively rigid member retained by said strips of material overlying and underlying portions of said elongated relatively rigid member, said plurality of substantially parallel slits comprising at least four slits with three adjacent strips of said upper layer of sheet material therebetween, said three adjacent strips comprising a central strip and two outer strips and said elongated relatively rigid member including a central portion between opposite end portions, said central portion of said relatively rigid member underlying said central strip, and said outer portions of said relatively rigid member overlying said two outer strips and being tucked under portions of said upper layer lying outside of said outer strips.

5. A golf glove and golf stroke counter combination as set forth in claim 4 wherein said indicia are located on one of said outer strips.

6. A golf glove and golf stroke counter combination comprising a golf glove having a back thereon, a plurality of layers of sheet material associated with said back, a plurality of indicia associated with one of said layers, and a cursor effectively retained between said layers for selective manual movement relative to said indicia to thereby indicate the number of golf strokes taken by a golfer, said plurality of layers of sheet material comprising an upper layer and a lower layer, and said cursor comprising an elongated relatively rigid member having portions located between said layers, an end portion on said elongated relatively rigid member, pivot means securing said end portion relative to said layers, an elongated arcuate slot in said upper layer concentric with said pivot means, and a knob on said elongated relatively rigid member extending through said slot for grasping and actuating said elongated relatively rigid member.

7. A golf glove and golf stroke counter combination as set forth in claim 6 including a second arcuate slot concentric with said arcuate slot, and located on the opposite side thereof from said pivot means, and wherein said indicia are associated with said second slot.

8. A golf glove and golf stroke counter combination as set forth in claim 7 wherein said indicia are located on said lower layer underlying said second arcuate slot.

9. A golf glove and golf stroke counter combination comprising a golf glove having a back thereon, a plurality of layers of sheet material associated with said back, a plurality of indicia associated with one of said layers, a cursor effectively retained between said layers for selective manual movement relative to said indicia to thereby indicate the number of golf strokes taken by a golfer, said plurality of layers of sheet material comprising an upper layer and a lower layer, said cursor comprising an elongated relatively rigid member having portions located between said layers, an end portion on said elongated relatively rigid member, pivot means securing said end portion between said layers, an elongated arcuate slot in said upper layer concentric with said pivot means, said indicia being associated with said slot, and knob means secured to said elongated relatively rigid member for pivoting said member relative to said indicia.

10. A golf glove and golf stroke counter combination as set forth in claim 9 wherein said knob is secured to said pivot means.

11. A golf glove and golf stroke counter combination as set forth in claim 9 wherein said indicia are located on said lower layer underlying said slot.

12. A golf glove and golf stroke counter combination comprising a golf glove having a back thereon, a plurality of layers of sheet material forming an original portion of said back, a cursor effectively retained between said layers for selective manual movement, a plurality of indicia on said cursor, said plurality of layers of sheet material comprising an upper layer and a lower layer, said cursor comprising a circular dial having a central portion and an outer portion, an opening in said upper layer, a knob on said central portion extending through said opening, a border on said upper layer outside of said opening and overlying said outer portion of said dial, and said lower layer underlying said dial.

13. A golf glove and golf stroke counter combination as set forth in claim 12 wherein said plurality of indicia are located on said outer portion of said dial, and means on said outer layer for designating a specific one of said indicia on said dial.

14. A golf glove and golf stroke counter combination as set forth in claim 13 wherein said means on said outer layer for designating a specific one of said indicia on said dial comprises a second opening in said border.

15. A golf glove and gold stroke counter combination comprising a golf glove, a back on said golf glove, a glove fastening tab selectively securable to said back, a plurality of layers of material forming an original portion of said glove fastening tab, central portions on said plurality of layers of material, stitching fastening said plurality of layers of material together outside of said central portions, a cursor having a first portion movably retained between said central portions of said plurality of layers and a second portion which is exposed to view, a plurality of indicia associated with said cursor and one of said layers, and means for manually moving said cursor between said layers to cause said indicia to indicate the number of golf strokes taken by a golfer.

* * * * *

UNITED STATES PATENT AND TRADEMARK OFFICE

CERTIFICATE OF CORRECTION

PATENT NO. : 4,922,850

DATED : May 8, 1990

INVENTOR(S) : Woodroffe et al.

It is certified that error appears in the above-identified patent and that said Letters Patent is hereby corrected as shown below:

On the Title page, the line numbered [54], and at col. 1, line 1, correct the first two words of the title "Sulfur Equilibrium" to read --Super-Equilibrium--.

Signed and Sealed this

Twenty-second Day of October, 1991

*Attest:*

HARRY F. MANBECK, JR.

*Attesting Officer*

*Commissioner of Patents and Trademarks*